US006027335A

United States Patent [19]

Griffioen

[11] Patent Number: 6,027,335

[45] Date of Patent: Feb. 22, 2000

[54] PILOT ASSEMBLY

[76] Inventor: Robert Howard Griffioen, 66651 N. Centreville Rd., Sturgis, Mich. 49091

[21] Appl. No.: 09/244,301

[22] Filed: Feb. 3, 1999

[51] Int. Cl.[7] ..... F23Q 3/00

[52] U.S. Cl. ..... 431/266; 431/278; 431/355

[58] Field of Search ..... 431/354, 355, 431/278, 264, 266

[56] References Cited

U.S. PATENT DOCUMENTS 788,382 4/1905 Taylor ..... 431/355

1,387,565 8/1921 Thorp et al. ..... 431/355

*Primary Examiner*—Carroll Dority

*Attorney, Agent, or Firm*—Flynn, Thiel, Boutell & Tanis, P.C.

[57] ABSTRACT

A pilot assembly includes a two part pilot housing and an orifice member mounted between the two housing parts. One housing part is fixable to a mount in a gas burning device and has a through passage. The orifice member is received in the passage. At least a portion of the other housing part is received in the passage to fix the orifice member in the passage.

8 Claims, 9 Drawing Sheets

31A
50
107
113
106
66
105
64
115
117
36A
33A
17A
111
79
124
34A
73
97
76
73
77
94
35A
116
98
72
108
80
108
101
96
40A
68
51A
83
71
84
72
37A
78
92
74
82
81
52A
41A
28A

PILOT ASSEMBLY

FIELD OF THE INVENTION

The present invention relates to pilot assemblies, and, more particularly to pilot assemblies of the type having a changeable pilot orifice member.

BACKGROUND OF THE INVENTION

Gaseous fuel (hereafter for simplicity, gas) burning devices, such as conventional hot water heaters and gas fireplaces, typically burn natural gas or propane. Pilot assemblies are conventionally mounted in, and used to light, such gas burning devices. A conventional pilot assembly includes a pilot which continuously burns gas at a low rate to provide a pilot flame. The pilot flame in turn lights an adjacent main burner when gas is supplied to the main burner.

As a convenient example of a conventional environment for such a pilot assembly, a conventional gas fireplace GF (FIG. 7) includes a floor 8, a fireplace box 9 extending upwardly from the floor 8, and conventional fireplace hardware 10 mounted in the fireplace box 9. The box 9 encloses sufficient volume for the fireplace hardware 10 and fireplace flames. The fireplace hardware 10 includes a grate 11 (in broken lines) standing on the floor 8, imitation noncombustible logs 12 (in broken lines) resting on the grate 11, a main burner 13 mounted to the floor 8 in substantially hidden relation behind the grate 11 and logs 12, and a pilot assembly 15. The main burner has plural gas flame producing nozzles 14, some adjacent the pilot assembly 15.

A typical conventional pilot assembly 15 (FIG. 8) includes a horizontal mounting bracket 17 fixed by any conventional means, not shown, with respect to the main burner 13. The pilot assembly 15 is substantially hidden behind the main burner 13. The assembly 15 includes a pilot 19, an ignitor 21, a thermocouple 22, and a thermopile generator 23, which are fixed on, and extend vertically through, the mounting bracket 17 in side-by-side relation.

The pilot 19 (FIG. 8) includes a one piece housing 27 extending vertically through and fixed to the central portion of the bracket 17. A semirigid, metal, gas supply tube 28 connects the bottom of the pilot housing 27 through a conventional pilot valve V to a conventional gas source GS. A typical pilot valve V is spring biased closed (to block gas flow to the pilot 19), but can be opened manually and can be held open electrically (to allow gas flow to the pilot). FIG. 8 schematically shows a suitable conventional pilot valve V comprising a spring biased closed valve core C1 interposed between the gas source GS and pilot supply tube 28, and a manual opener (e.g. push button) B1 and electromagnetic hold-open (e.g. solenoid) E1 actuable to respectively open and hold-open the valve core C1 against its spring S1.

The upper end of the pilot housing 27 normally emits a pilot flame (not shown) fueled by gas supplied through the open valve V and tube 28. A pilot flame target 31 is fixed atop the housing 27 to direct the pilot flame laterally (to the right and left and forward out to the page in FIG. 8) along paths from the target 31. The top of the ignitor 21 (FIG. 8) is adjacent one side (the left side in FIG. 8) of the target 31, for igniting gas flow therefrom to establish the pilot flame of pilot 19. The tops of the thermocouple 22 and thermopile generator 23 closely flank the target 31 (FIG. 8), so as to be in the pilot flame path from opposite sides of the target 31 and with the ignitor 21 snugly spaced between the thermocouple 22 and target 31. The front of the flame target 31 is adjacent ones of the gas outlet nozzles of the main burner 13, such that the forward directed flame pilot flame component ignites the main burner 13.

An electrically insulated wire 24 (FIG. 8) electrically couples the bottom of the ignitor 21 to the output of a conventional ignitor voltage source, here for example a conventional, manually actuable, push button, piezo-electric voltage source PZ, grounded to the bracket 17. Given a supply of gas through the pilot valve V to the pilot 19, manual actuation of the piezo voltage source discharges an electrical spark between the tops of the ignitor 21 and pilot 19, thereby igniting the pilot gas flow and starting the pilot flame.

A relatively stiff wire 25 extends from the bottom of the thermocouple 22 to the control input of the electromagnetic hold-open E1 of pilot valve V. The thermocouple 22, when heated by the pilot flame from pilot 19, supplies a voltage (typically in the range of millivolts) to the solenoid E1 to maintain the valve V open and so maintain gas flow to the pilot and keep the pilot flame on. If the pilot flame becomes extinguished, the thermocouple 22 cools, its voltage output drops, and the solenoid E1 relaxes and the spring S1 closes the valve V and shuts off gas flow to the pilot 19.

The bottom of thermopile generator 23 (FIG. 8) connects through a heat shielded, relatively stiff, electrically insulated wire pair 26 to a main gas safety valve MV interposed between the conventional gas source GS and the main burner 13. The thermopile generator 23 responds to pilot flame heat to electrically open the main valve MV to supply gas from the gas source GS to the main burner 13 and responds to lack of pilot flame heat to close the valve MV and thus shut off gas flow to the main burner 13. The main safety valve MV may be a conventional solenoid valve (like pilot V but without the manual opener B1) comprising a valve core C2 spring biased closed by a spring S2 and openable by a solenoid E2.

Typically, a manual control MC, in the form of a manually adjustable valve, is in series with the main safety valve MV, between the gas source GS and main burner MB, to allow the human operator of the fireplace GF to turn on and off, and vary the flame height of, the main burner MB.

The top and bottom ends of the one-piece pilot housing 27 (FIG. 9) are spaced above and below the bracket 17. The housing 27 has a radially inwardly stepped, upper housing portion 45. The housing 27 also has a stepped axial through passage 29. The passage 29 has a substantially cylindrical top portion 42, an enlarged-diameter midportion 43 and a further enlarged-diameter, bottom opening, internally threaded recess 44. The portions 42 and 43 are separated by a tapered annular step 46. The midportion 43 and recess 44 are separated by an annular step 47, the upper portion of which is tapered upward and inward. The open top 48 of the passage 29 acts as the ignited gas/air mixture (flame) outlet nozzle of the pilot 19.

The pilot flame target 31 comprises a semi-circular base 38 which is fixed, by any convenient means, such as welding, to the upper housing portion 45. The target 31 has an inverted trough-like, pilot flame deflector 39 fixedly upstanding from the base 38 and spaced above the pilot flame nozzle 48 for deflecting the pilot flame laterally (to the left and right in FIG. 9) toward the ignitor 21, thermocouple 22 and thermopile generator 23 and forwardly (out of the page in FIG. 9) toward the main burner 13.

At least one air supply aperture 32 opens radially through the peripheral wall of the housing 27 and into the midportion 43 of the passage 29. The aperture 32 may be above the bracket 17 as here shown, or below it.

An inverted cup-shaped, pilot orifice-containing member 33 includes a substantially cylindrical peripheral wall 35, a horizontal top end wall 36, a central orifice 34 preferably centered in the end wall 36, and a radially outwardly and downwardly flared bottom flange 40. The orifice member 33 is assembled in the pilot housing 27 by upward insertion through the threaded bottom recess 44. When so installed, as seen in FIG. 9, the top end wall 36, with its orifice 34, is located closely below the air aperture 32, the peripheral wall 35 is in snug sliding engagement with the lower portion of the passage midportion 43, and the bottom flange 40 snugly abuts the tapered step 47.

The pilot gas supply tube 28 has an upper end fixedly tipped by a ferrule 37 (FIG. 9) that is tapered at its upper and lower ends 51 and 52.

A spool-like, annular fitting 41 (FIG. 9) is snugly but axially and rotatably slidably sleeved on the gas supply conduit 28 below the ferrule 37. The fitting 41 adjacent its lower end has a wrench-engageable (here hexagonal) rim 53. The fitting 41 is externally threaded at 54 adjacent its upper end and has a central throughbore 55. The upper end of the fitting throughbore 55 is tapered at 56. The gas supply tube 28 is fixed to the bottom of the housing 27 by inserting the ferrule 37 into the housing bottom recess 44 until it rests against the tapered bottom flange 40 of the orifice member 33. The fitting 41 is then threaded into the threaded bottom recess 44 of the housing 27. Threadedly tightening the fitting 41 axially presses it, fitting taper 56 to ferrule taper 52, against the bottom of the ferrule 37 and in turn presses the ferrule 37 axially upward so that its upper taper 51 forcibly presses the bottom flange 40 against the tapered step 47 of the housing 27. This locks in place the orifice member 33 in the housing 27 and prevents leakage of gas, such that all gas from the gas supply tube 28 must pass up through the orifice 34 and mix with air from the aperture 32, and such that the resultant gas/air mixture must pass upwardly through the passage top portion 42 and out the nozzle 48 for ignition and production of the pilot flame.

However, different fuel gases differ in energy content and so require different sized orifices 34 to supply gas at different flow rates for maintaining the desired size pilot flame. Manufacturers, retailers, and repair persons must thus inventory different pilot assemblies 15 (FIG. 8) for different gaseous fuels, or must change the orifice member 33 (FIG. 9) in a given assembly if a different fuel gas than originally contemplated is to be used. Unfortunately, inventorying different pilot assemblies 15, and more importantly appliances incorporating them, is space consuming and expensive.

Also, unfortunately, in such prior pilot assemblies 15 (FIG. 8), changing the orifice member 33 (FIG. 9) is difficult and time consuming because access to the orifice member 33 is difficult before, and particularly after, prior pilot assembly 15 is installed in a gas burning device, for example a fireplace or water heater. More particularly, to remove the existing pilot orifice member 33, the fitting 41 and gas supply tube 28 must be removed from the bottom of the pilot 19. However, access to the fitting 41 is usually, at least partially, blocked, e.g. by the bracket 17 and main burner 13, if not additionally by user device structure, such as the nonflammable logs 12, grate 11 or a fireplace box 9 (FIG. 7). Further, the stiffness of the gas supply tube 28 requires either that it be bent (thus risking kinking and disabling) away from the pilot 19, or that the bracket 17 be disconnected from supporting structure of a user device and that the relatively stiff electrical conductor members 25, 26 also be disconnected to enable access to the bottom of the pilot 19.

Accordingly, objects of the present invention include providing a pilot assembly having more efficient access to the pilot orifice member, and easing converting the pilot from one gaseous fuel to another.

SUMMARY OF THE INVENTION

The objects and purposes of the present invention, including those set forth above, are met, according to one form of the present invention, by providing a pilot assembly which includes two pilot housing parts, and a pilot orifice member mounted between the two pilot housing parts. One pilot housing part is fixed to a gas supply. The second pilot housing part is removably fixed to the one pilot housing part. In another embodiment of the present invention, the pilot orifice member is accessible from above a bracket by removing an upper housing part upwardly from a cover housing part.

Figure 1:
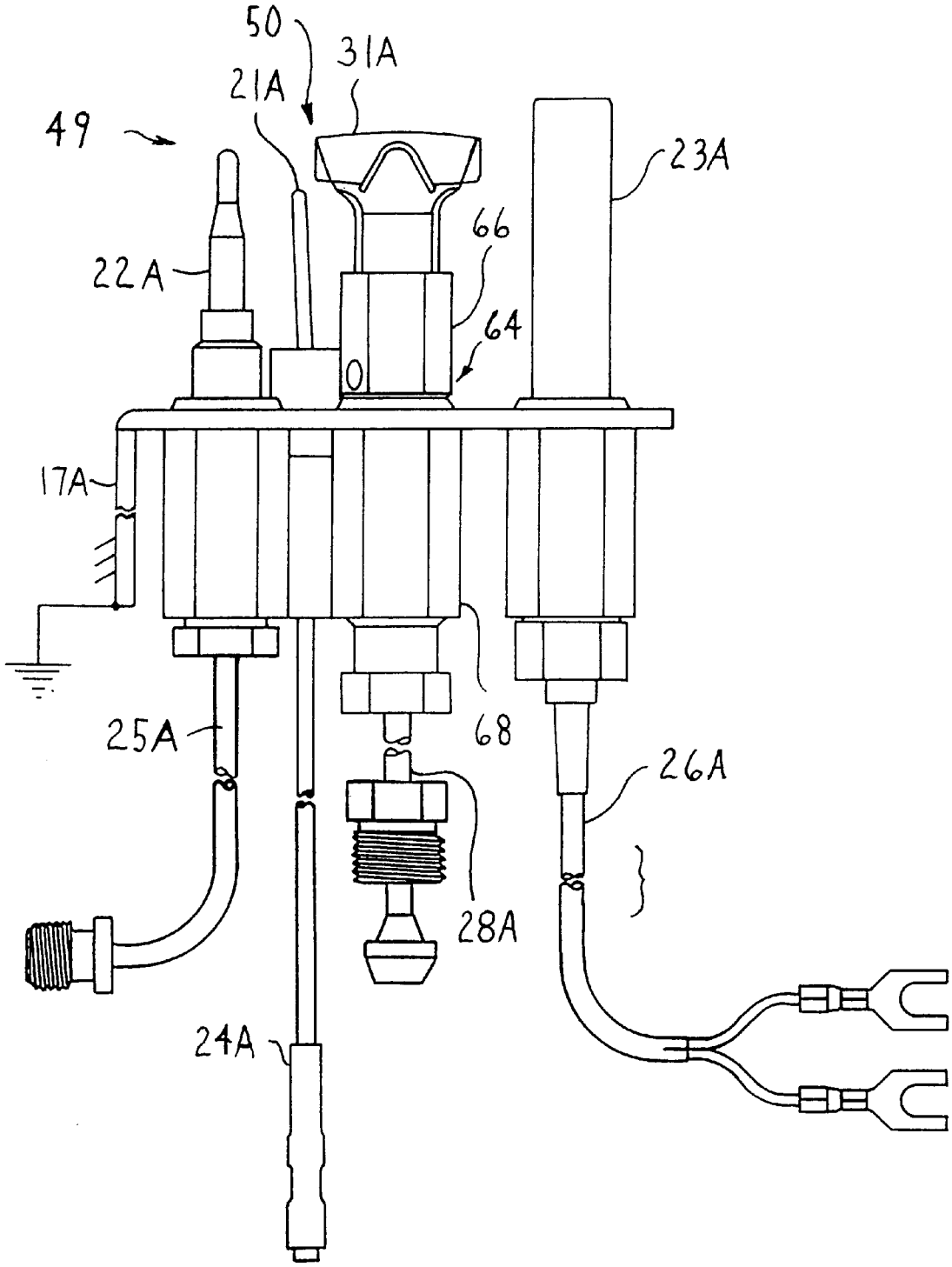
FIG. 1 is an elevational view of a pilot assembly embodying the invention.
Figure 2:
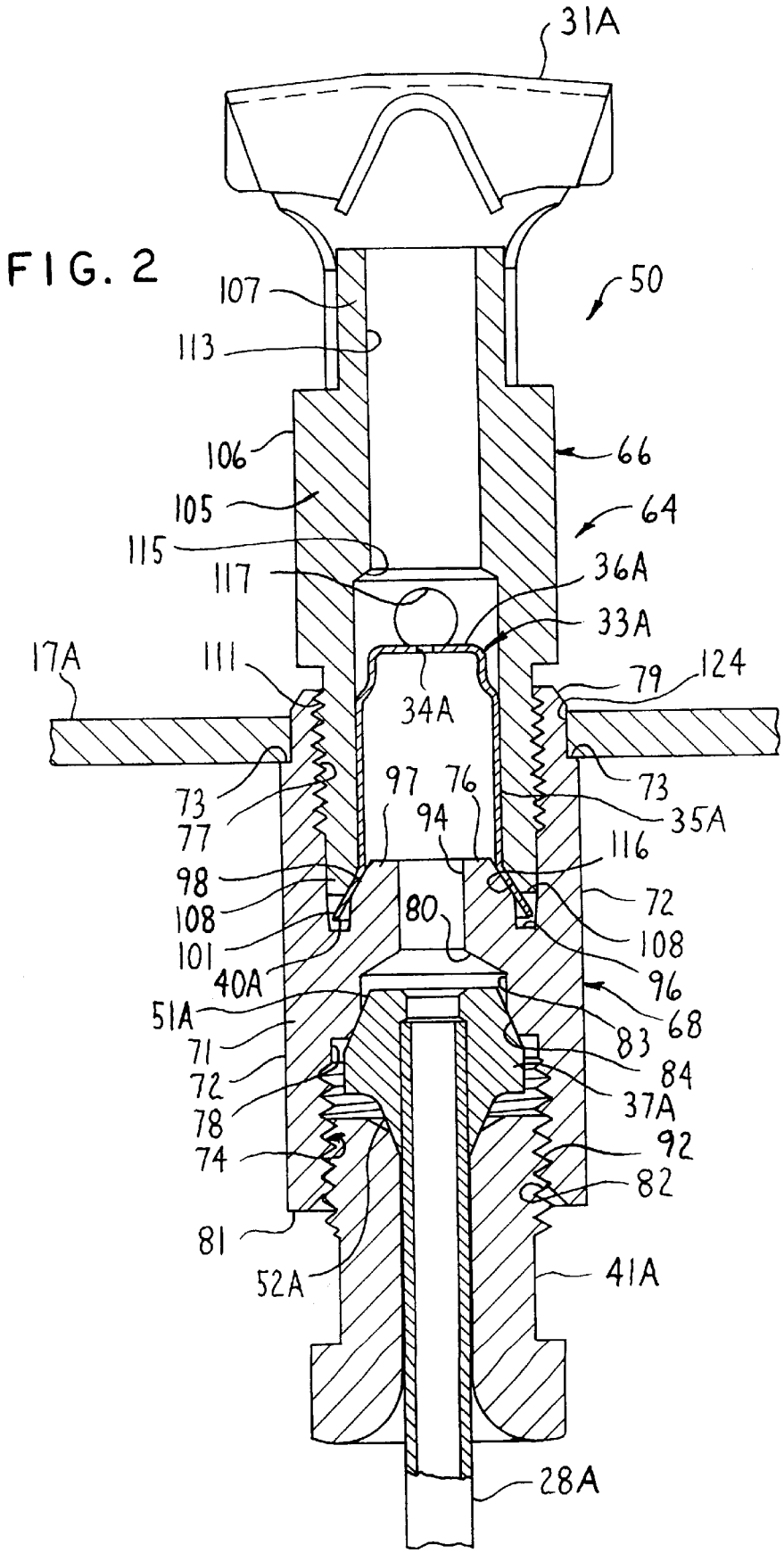
FIG. 2 is a cross sectional view of the pilot of FIG. 1.
Figure 3:
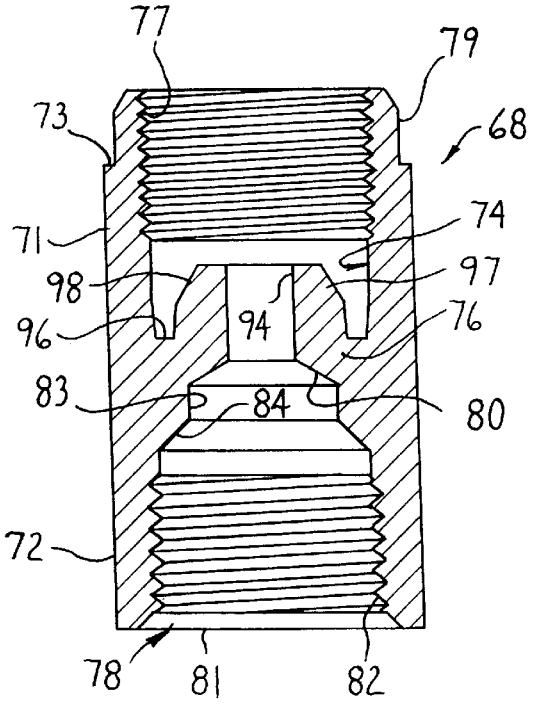
FIG. 3 is a cross sectional view of the lower housing member of the pilot of FIG. 2.
Figure 4:
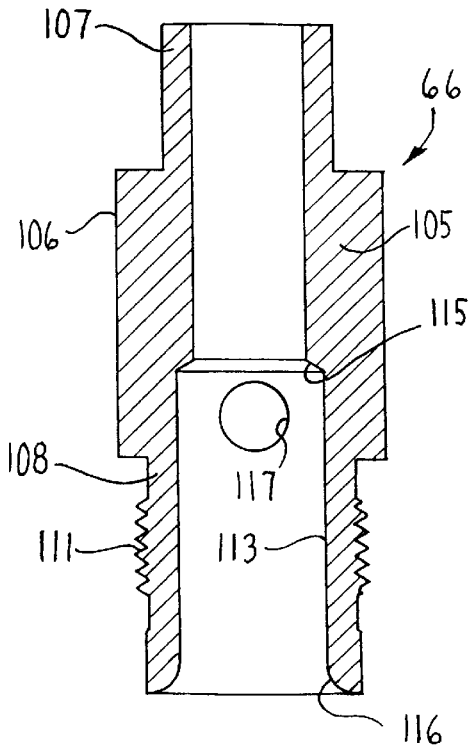
FIG. 4 is a cross sectional view of the upper housing member of the pilot of FIG. 2.

Certain terminology will be used in the following description for convenience in reference only and will not be limiting unless explicitly recited in the claims. The words "up", "down", "top", "bottom" will designate directions in the drawings to which reference is made. Such terminology will include derivatives and words of similar meaning.

DETAILED DESCRIPTION

FIGS. 1–4 disclose a pilot assembly 49 embodying the present invention. While the present invention may be embodied in other structures, for convenience in present disclosure the pilot assembly 49 of FIGS. 1–4 is described below as an improvement on, and hence modification of, the prior art pilot assembly 15 above discussed as to FIGS. 7–10. Thus, for convenient reference, parts of the inventive pilot assembly 49 (FIGS. 1–4) substantially corresponding to parts of the prior art pilot assembly 15 will be referred to by the same reference numerals, with the suffix "A" added. Thus, the FIGS. 1–4 pilot assembly may be similar to that shown in FIGS. 7–10 except as follows.

The inventive pilot assembly 49 (FIG. 1) includes an improved pilot 50. The pilot 50 (FIG. 2) includes a two-part housing 64 comprising a substantially tubular upper housing member 66 and a substantially tubular lower housing member 68.

The lower housing member 68 (FIGS. 2 and 3) comprises an elongate, generally cylindrical peripheral wall 71 whose exterior surface 72 is radially inwardly stepped at 73 to narrow the upper end portion 79. The step 73 seats against the bottom of the mounting bracket 17A. The lower housing member upper end portion 79 is fixed to the mounting bracket 17A by any conventional means, for example staking, welding, etc. The major length of the lower housing member 68 depends downwardly from the mounting bracket 17A and ends at 81. A diametral, preferably integral wall 76 divides the lower housing passage 74 into upper and lower internally threaded, recesses 77, 78. The diametral wall 76 includes a coaxial boss 97 protruding upwardly into the upper recess 77. An annular gap 96 radially spaces the boss 97 from the interior surface of the peripheral wall 71. The boss 97 has an upwardly inwardly tapered peripheral wall 98. The diametral wall 76 is axially perforated by a reduced diameter gas flow hole 94 coaxially connecting the greater diameter upper and lower recesses 77, 78.

The lower recess 78 (FIG. 3) is stepped radially outward and downward. Starting downward from the diametral wall 76, the lower recess 78 includes an inner, downward flared, tapered step 80; an increased diameter, cylindrical wall 83; an outer tapered step 84; and an internally threaded, substantially cylindrical mouth 82.

The ferrule 37A (FIG. 2), gas supply tube 28A and fitting 41A are all received in the mouth 82 of lower recess 78. Tightly threading the fitting 41A into the threaded mouth 82 gas sealingly seats the ferrule upper tapered surface 51A against the tapered step 84.

The upper housing member 66 (FIGS. 2 and 4) comprises an elongate, hollow, generally tubular wall 105 having upper and lower end portions 107 and 108, axially flanking a midportion 106. The midportion 106 has a wrench engageable (e.g. hexagonal) outer surface. The lower end portion 108 is externally threaded at 111. The upper and lower end portions 107, 108 are stepped radially inward from the periphery of the midportion 106. The upper housing member 66 includes a coaxially extending through passageway 113 having a downward facing, tapered annular midstep 115 and a convexly radiused bottom step 116. An air supply aperture 117 opens radially through the peripheral portion of the upper housing member 66 just below the midstep 115 and above the lower end portion 108.

The pilot 50 (FIG. 2) is assembled as follows. The lower housing member 68 is inserted upwardly snugly into a hole 124 in bracket 17A until the stop 73 abuts the underside of the bracket. The member 68 is fixed pendently to the bracket 17A by any convenient means (e.g. peening, welding, etc.).

The gas supply tube 28A, ferrule 37A and fitting 41A are then upwardly inserted in the lower recess 78. Threadedly tightening the fitting 41A in the threaded mount 82 sealingly wedges the tapered upper end 51A of the ferrule 37A against the tapered step 84 of the lower housing member 68.

Then, the orifice member 33A is centered in the upper recess 77 of the lower housing member 68 with its flared lip 101 coaxially fitted on the tapered peripheral wall 98 of the boss 97.

Then, the upper housing member 66 is sleeved over the orifice member 33A and threaded into the upper recess 77 of the lower housing member 68 until the lip 101 is tightly and sealingly sandwiched between the tapered wall 98 of the lower housing member 68 and the tapered bottom step 116 of the upper housing member 66. The tapers of the wall 98, step 116 and lip 101 are substantially equal to provide a circumferentially complete axially extended gas seal therebetween.

To convert the pilot 50 to a different fuel gas, the upper housing member 66 and orifice member 33A are upwardly removed from the lower housing member 68, a new orifice member 33A of different, suitable orifice 34A diameter is inserted and the upper housing member 66 is replaced on the lower housing member 68. Advantageously, this can be done from entirely above the bracket 17A and there is no need of access below the bracket 17A or removal of the gas supply tube 28A (or electrical members 24, 25 or 26) or dismantling of bracket 17A or adjacent user structure (e.g. FIG. 7 fireplace structure).

MODIFICATION

Figure 5:
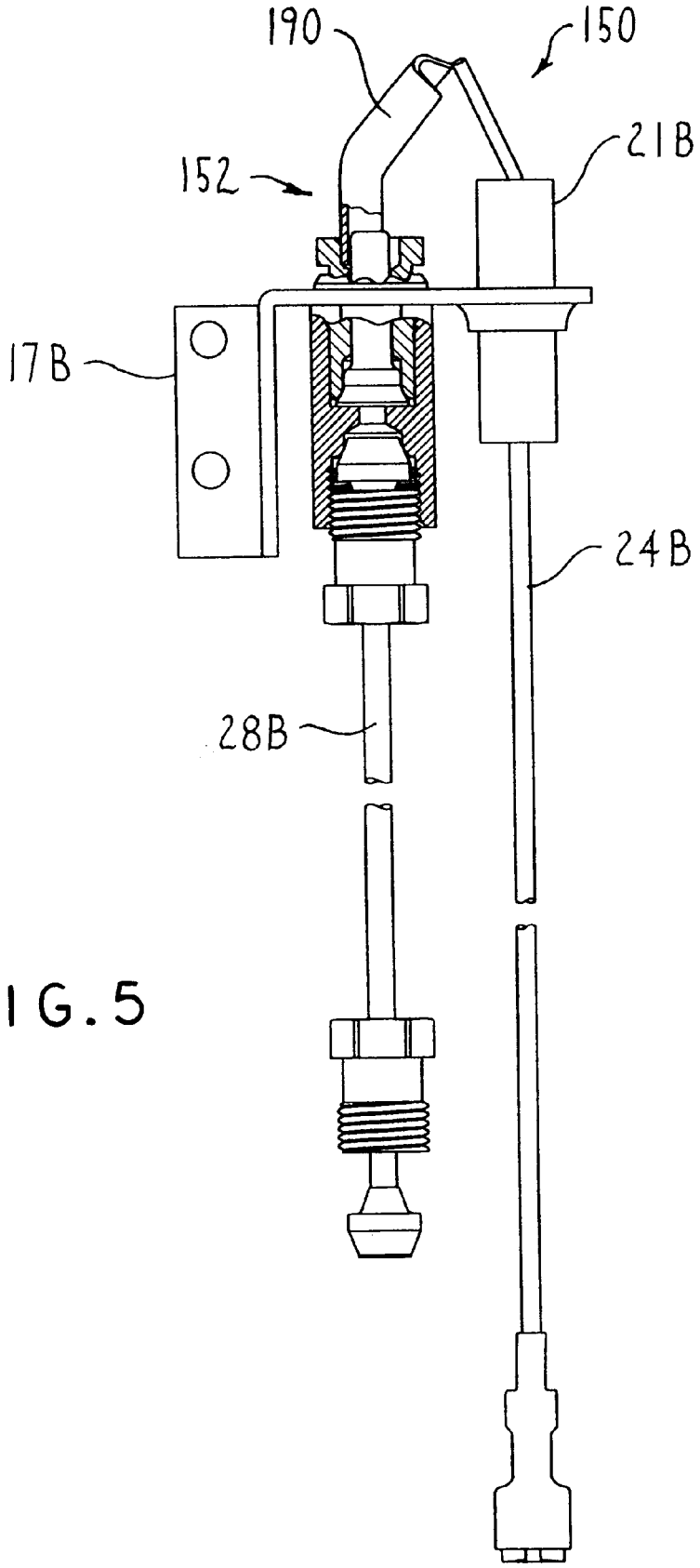
FIG. 5 is an elevational view of a modified pilot assembly embodying the invention.
Figure 6:
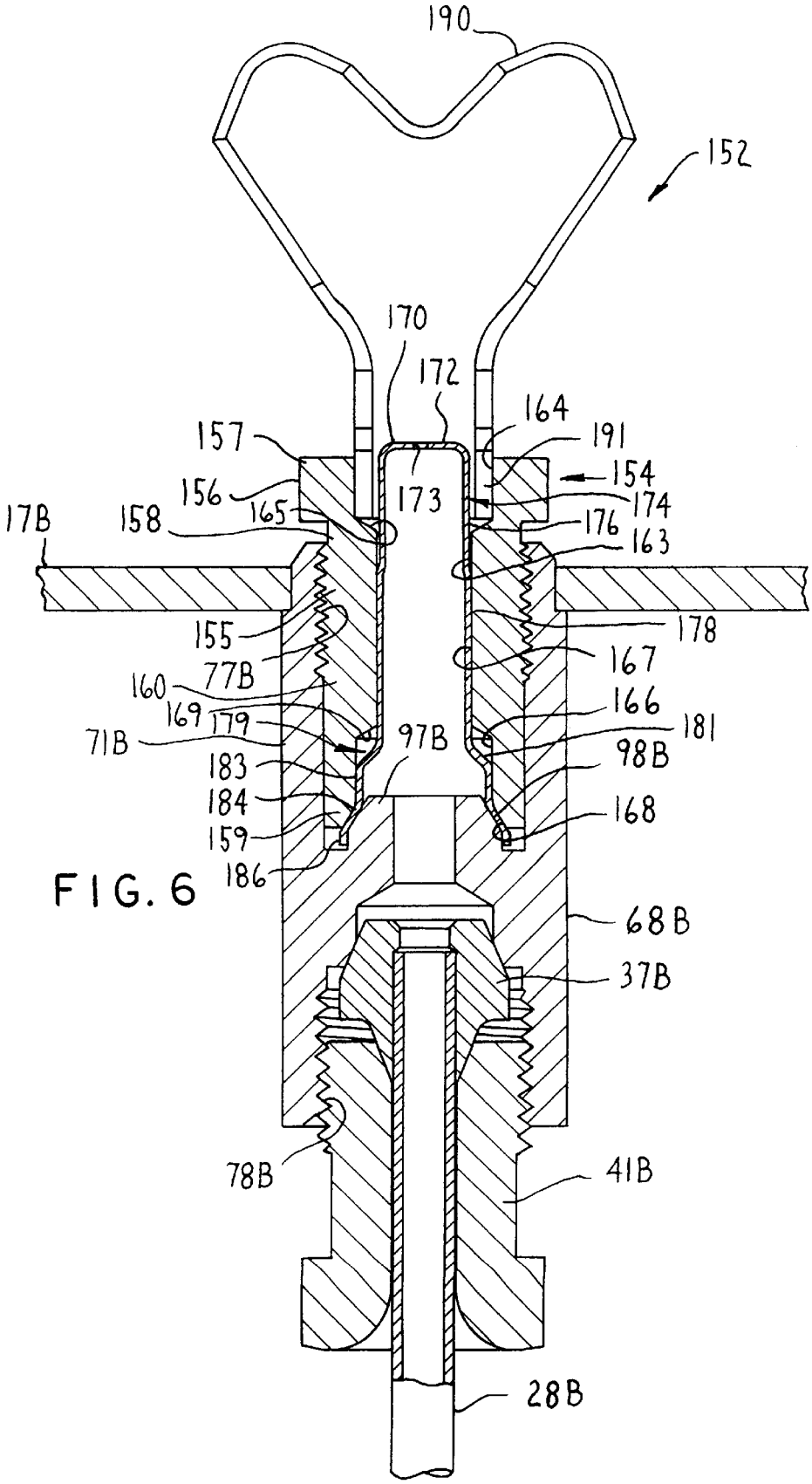
FIG. 6 is a cross sectional view of the pilot of FIG. 5.
Figure 7:
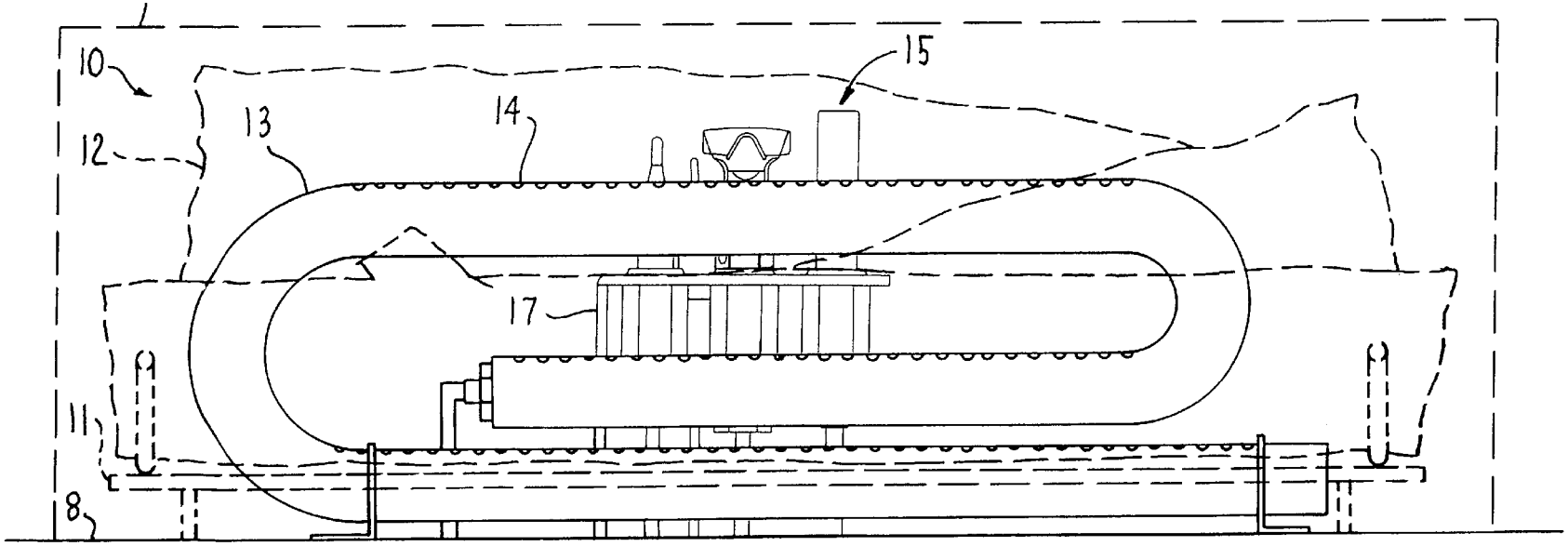
FIG. 7 PRIOR ART
FIG. 7 is a front view of a typical conventional fireplace, equipped with a prior art pilot assembly, and with the fireplace box, grate, and nonflammable logs shown in broken line.
Figure 8:
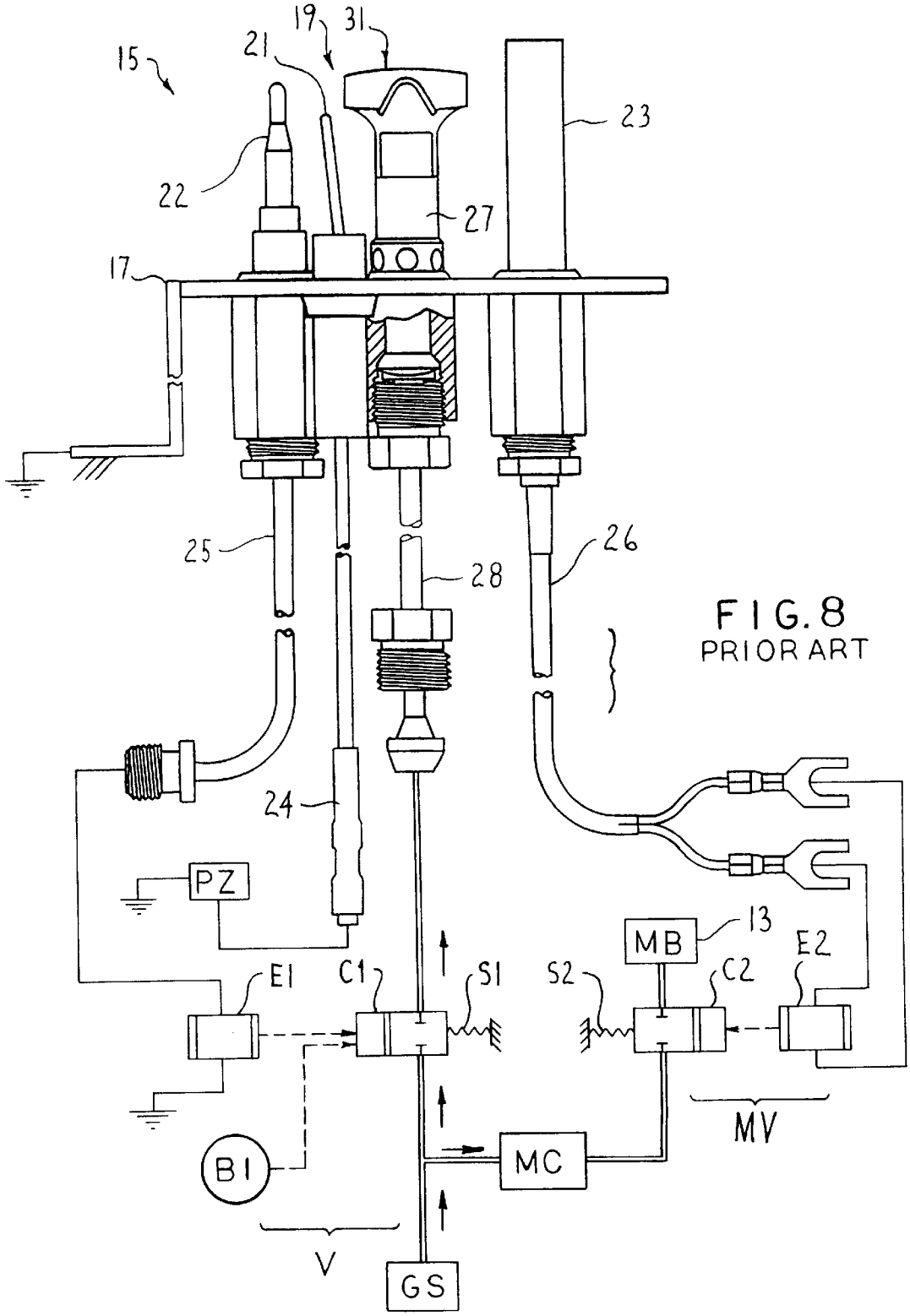
FIG. 8 PRIOR ART
FIG. 8 is a front view of the prior art pilot assembly of FIG. 7.
Figure 9:
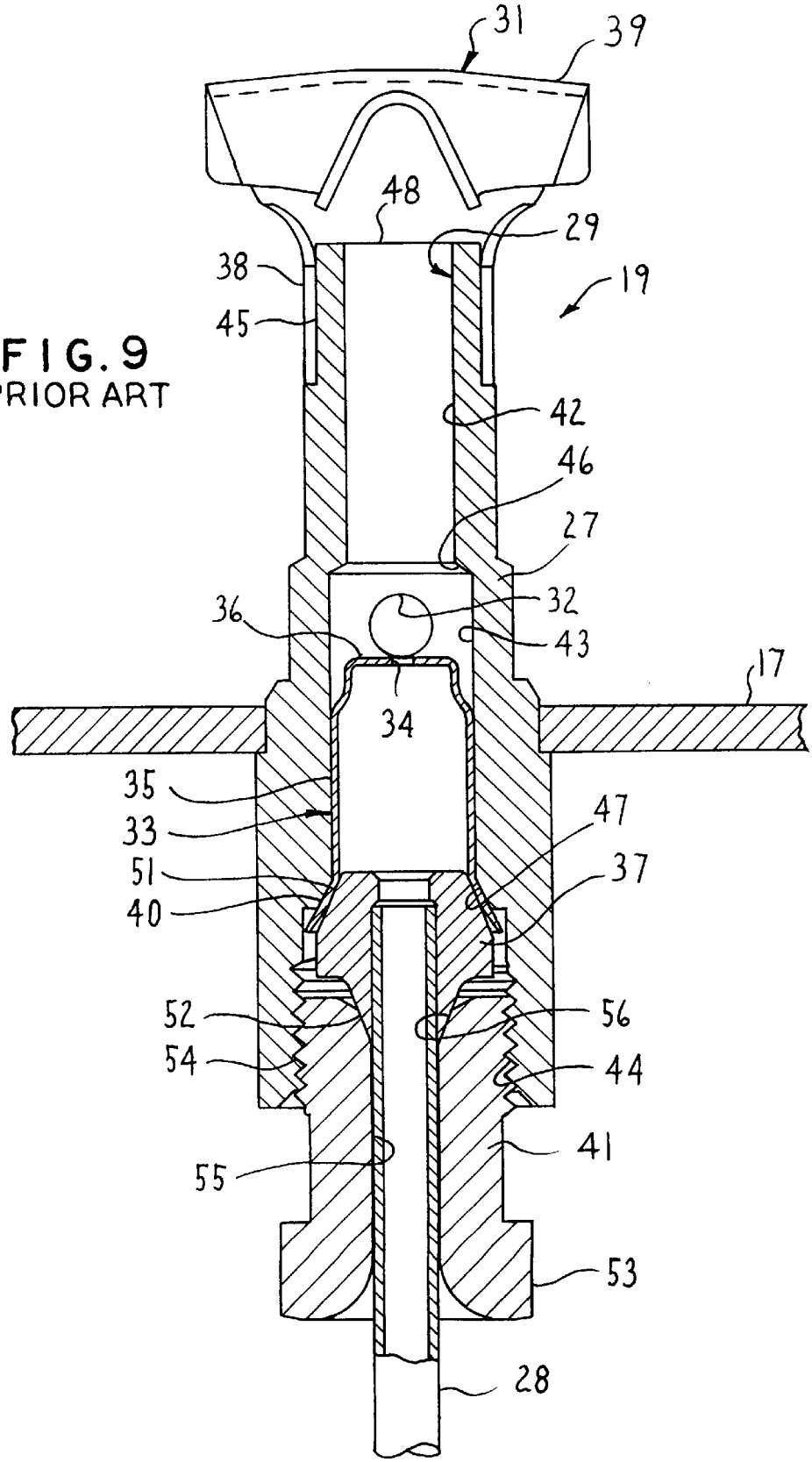
FIG. 9 PRIOR ART
FIG. 9 is a cross sectional view of the prior art pilot of FIG. 8.
Figure 10:
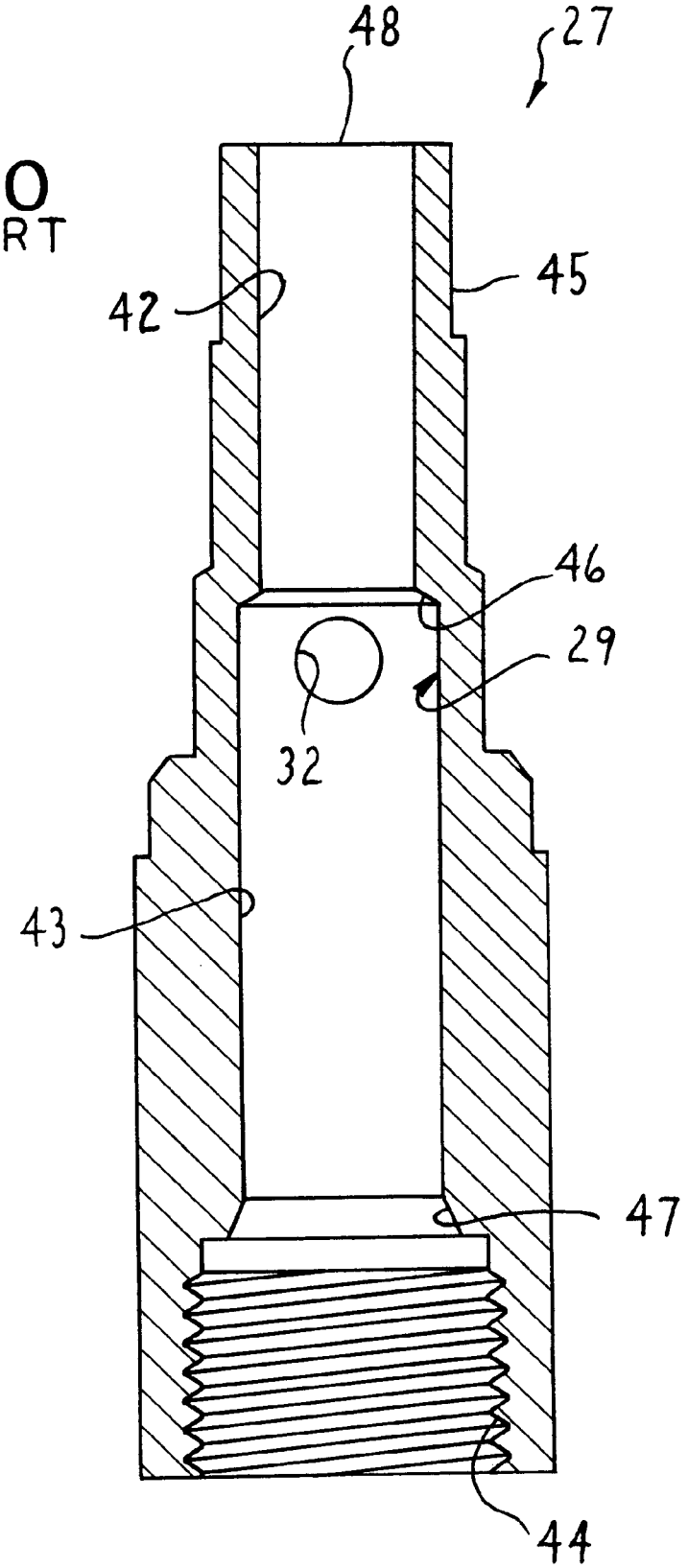
FIG. 10 PRIOR ART
FIG. 10 is a cross sectional view of the housing of the FIG. 9 pilot.

A typical modified inventive pilot assembly 150 (FIGS. 5 and 6) may be used in water heaters. For convenient reference parts of the pilot assembly 150 substantially corresponding to parts of the pilot assembly 49 of FIG. 1 will be referred to by the same reference numerals with the suffix "B" added. The FIGS. 5 and 6 pilot assembly is preferably similar to that of FIGS. 1–4 except as follows.

The modified pilot assembly 150 (FIGS. 5 and 6) includes a bracket 17B, which fixedly mounts an ignitor 21B and a pilot 152.

The pilot 152 has a lower housing member 68B (FIG. 6) fixed to and depending from the bracket 17B. The lower body member 68B differs from the member 68 (FIG. 3) primarily in that its peripheral wall 71B is longer, axially between the threads 77B and the boss 97B, than the peripheral wall 71.

The pilot 152 includes an upper housing member 154.

The upper housing member 154 (FIG. 6) has an elongate, generally tubular peripheral wall 155 having upper and lower end portions 157 and 159 flanking a midportion 160. The upper end portion 157 has a wrench engageable (e.g. hexagonal) outer surface portion 156. The midportion 160 has a threaded outer surface 158. The member 154 has a coaxial through passage 163. The passage 163 is generally of hour glass shape and includes an upper, enlarged diameter, target receiving recess 164, a lower, enlarged diameter recess 166, and a reduced diameter intermediate portion 167 connected by tapered steps 165 and 169 to the upper and lower recesses 164 and 166. The lower recess 166 has a downward facing, tapered step 168 at its lower end.

An inverted, cup shaped orifice member 170 includes a top end wall 172, a stepped peripheral wall 174 depending from end wall 172, and a stepped flared skirt 179 depending from the peripheral wall 174. The top end wall includes a central orifice 173. The peripheral wall 174 includes an upper wall portion 176, which has a diameter less than the intermediate passage portion 167 and extends downwardly partly into the intermediate passage portion 167, and a lower wall portion 178 of diameter slightly greater than the upper wall portion 176. The skirt 179, in descending order, includes an upper, downward facing, frustoconical step 181, an upper cylindrical part 183, a lower, downward facing frustoconical step 184, and a lower cylindrical part 186.

A bidirectional target 190 (FIG. 6) includes a semicylindrical mounting base 191. The base 191 is fixed in the target receiving recess 164 by any conventional means, for example by welding.

The pilot 152 is preferably assembled as follows. First, the gas supply tube 28B, ferrule 37B, lower housing member 68B and bracket 17B may be assembled together in the manner shown in FIG. 6 and generally as discussed above with respect to corresponding elements 28A, 37A, 68 and 17A of FIGS. 1 through 4.

Then, the orifice member 170 (FIG. 6) is centered in the upper recess 77B of the lower housing member 68B with its tapered stop 168 coaxially fitted on the tapered peripheral wall 98B of the boss 97B.

Then, the upper housing member 154 is sleeved over the orifice member 170 and threaded into the upper recess 77B of the lower housing member 68B until it stops. As a result, the upper housing member snugly radially backs the orifice member lower peripheral wall portion 178. Also, the boss tapered peripheral wall 98B and opposed upper housing member tapered step 168 tightly and sealingly sandwich the orifice member lower frustoconical part 184 (such elements 98B, 168 and 184 having substantially identical tapers to facilitate sealing). Further, the orifice member upper peripheral wall portion 176 extends loosely up into the target mounting base 191, ending just above the top of the upper housing member 154.

Thus, gas exits the orifice 173 directly into the target 190 (not into the housing as in the FIG. 1–4 embodiment), whereat the gas ignites into the pilot flame.

Advantageously, the pilot assembly 50, 150 allows removal and replacement of the orifice member 33A, 170 from above the mounting bracket 17A, 17B by providing a two part pilot, in which the upper housing member 66, 154 can be respectively removed from above the mounting bracket 17A, 17B to allow replacement of the orifice member 33A, 170 from above.

Although particular preferred embodiments of the invention have been disclosed in detail for illustrative purposes, it will be understood that variations and modifications of the disclosed apparatus, including the rearrangement of parts, lie within the scope of the present invention.

What is claimed is:

1. A gas ignition assembly for a gas burning device, comprising:

a mount;

a pilot for providing a pilot flame to ignite gas in a gas burning device, the pilot comprising first and second members containing a gas metering orifice member, the first member being fixed to the mount and having a gas receiving portion on one side of the mount, the second member being fixed with respect to the mount and first member and removable therefrom from the other side of the mount to allow replacement of the orifice member.

2. The gas ignition assembly according to claim 1, wherein the first and second members are elongate and tubular, the first member has a diametral wall dividing its interior into a gas receiving chamber and a member-receiving chamber, the orifice member is fixed in the member-receiving chamber by the second member, the orifice member has an orifice for gas flow from said first member to sid second member, the orifice member being replaceable upon removal of the second member from the first member.

3. The gas ignition assembly according to claim 2, wherein the diametral wall has an axially extending boss, the boss extends toward said second member and into the member-receiving chamber, the boss being received in the orifice member, the orifice member including a portion gas tightly pressed between the second member and boss.

4. The gas ignition assembly according to claim 3, wherein the second member has a through passage, the orifice member extending from said boss into said throughpassage, said first and second members being relatively telescoped, said orifice member being surrounded by telescoped portions of said first and second members.

5. The gas ignition assembly according to claim 3, wherein the mount carries an ignitor for igniting gas from the pilot to create a pilot flame on the pilot, a thermocouple fixed on the mount for sensing the pilot flame, and a generator fixed on the mount for responding to a pilot flame by enabling gas flow to a gas burning device.

6. A pilot assembly for producing a pilot flame, for use in a gas burning device, comprising:

a mounting bracket for fixing the assembly with respect to a gas burning device;

a first housing member fixed to the bracket, the first member being extending in a first direction from the bracket, the first member having a gas receiving portion remote from the bracket, the first member having a pilot member-receiving end adjacent the bracket;

an orifice member received in said first member end and having an orifice for throttling a gas flow; and a second housing member removably fixed to said end of the first member and enclosing said orifice member.

7. The pilot assembly according to claim 6, wherein said first member has an axial through passage and a diametral wall that divides the through passage into upper and lower recesses,the upper recess removably securing the second member and orifice-containing member therein, and the lower recess being adapted to receive gas.

8. In combination, a gas burning device including a main gas burner and a pilot assembly, the pilot assembly producing a pilot flame for igniting gas from the main burner, the pilot assembly comprising:

a mounting bracket fixed adjacent to the gas burning device, the bracket having first and second sides, a first pilot housing member fixed to the bracket, said first housing member having an axial through passage and a transverse wall dividing the passage into first and second recesses, a gas supply connection on the first housing member, said connection being open to said first recess and on said first side of said bracket, an orifice member removably seated on said wall in said second recess, the orifice member having an orifice for controlling gas flow to the pilot flame, and a second pilot housing member removably fixed to said first housing member and removably fixing the orifice member in said second recess, said second pilot housing member extending from the first pilot housing member and from the second side of said bracket.

* * * * *